US005085419A

United States Patent [19]

Bell

[11] Patent Number: 5,085,419

[45] Date of Patent: Feb. 4, 1992

[54] PAPER FEEDER INSERT TRAY

[75] Inventor: Conrad J. Bell, Webster, N.Y.

[73] Assignee: Xerox Corporation, Stamford, Conn.

[21] Appl. No.: 647,853

[22] Filed: Jan. 30, 1991

[51] Int. Cl.[5] ..... B65H 5/26

[52] U.S. Cl. ..... 271/9; 271/171

[58] Field of Search ..... 271/2, 9, 145, 161, 271/164, 171

[56] References Cited

U.S. PATENT DOCUMENTS

| | | | |
|---|---|---|---|
| 4,131,274 | 12/1978 | Sue | 271/9 |
| 4,303,235 | 12/1981 | Calabrese | 271/9 |
| 4,538,799 | 9/1985 | Bhagwat | 271/9 |
| 4,838,535 | 6/1989 | Yokoij et al. | 271/171 |
| 4,991,830 | 2/1991 | Yamanaka | 271/9 |

FOREIGN PATENT DOCUMENTS

| | | | |
|---|---|---|---|
| 9646 | 1/1982 | Japan | 271/9 |
| 227638 | 12/1984 | Japan | 271/171 |

OTHER PUBLICATIONS

Brown, L. C., et al., "Dual Paper Cassettes With Common Feed Mechanism", *IBM Technical Disc. Bull.* vol. 23, No. 7A, pp. 2683-2685 (12/80).

*Primary Examiner*—Robert P. Olszewski
*Assistant Examiner*—Steven M. Reiss
*Attorney, Agent, or Firm*—William A. Henry, II

[57] ABSTRACT

In order to minimize the handling of large copy sheets when the feeding of a different size or type of copy sheet is required, and insertable copy sheet tray is included that is inserted on top of copy sheets already in a copy sheet tray for feeding purposes and removed once the requisite number of different size or type of copy sheets have been fed.

3 Claims, 4 Drawing Sheets

PAPER FEEDER INSERT TRAY

Cross reference is hereby made to copending and commonly assigned U.S. application Ser. No. 647,854, filed on Jan. 30, 1991 and entitled Flexing Paper Tray by Conrad John Bell.

This invention relates to printing machines, and more particularly, to an insert tray to be used with such a machine.

In the art of xerography or other similar image reproducing arts, a latent electrostatic image is formed on a charge-retentive surface such as a photoconductor which generally comprises a photoconductive insulating material adhered to a conductive backing. This photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purpose of the present invention, the latent electrostatic image may be generated from information electronically stored or generated, and the digital information may be converted to alphanumeric images by image generation electronics and optics. However, such image generation electronic and optic devices form no part of the present invention.

Paper feeders are used with automated drive rolls throughout the industry in conjunction with printers or copiers of the type just discussed in order to feed copy sheets at a high rate of speed and thereby increase the throughput of the machines. These feeders are costly, cumbersome and labor intensive when evaluated for use in feeding large sheets in low cost, slow speed machines. For example, U.S. Pat. No. 4,538,799 discloses a sheet feeding apparatus for a copying machine that includes two trays carried one above the other by a tray carriage and arranged for independent slideable withdrawal from the tray carriage towards the front of the machine. The feeding apparatus is adapted such that either tray can be brought into engagement with a feed means. Also, it has become increasingly common to feed large copy sheets (i.e., 11×17", 12×18", 18×24", 24×36" or 36×48", etc.) in some of these low speed machines, however, use of prior sheet feeders for this application has been difficult at best. One of the problems with feeding "C", "D" and "E" size copy sheets is that in order to replace, for example, a "D" size stack of copy sheets with a B size stack of copy sheets, one must remove the large hard to handle "D" size media from a media tray and insert the new B size media therein. This labor intensive and awkward process must be repeated for each change in media size desired. Therefore, an easier and less awkward process for changing copy media in large document copiers is needed.

Accordingly, to answer this need and in accordance with the present invention, a paper feeder insert tray is disclosed which comprises a copy media holding portion, upstanding side and end portions and a downturned front end, all with respect to the media holding portion. In use, the paper feeder insert tray is filled with the size copy media desired and inserted onto the top of existing copy media in a media tray of a machine. The downturned end of the insert tray locates the copy media with respect to feed rolls of the machine.

The accompanying drawings, which are incorporated in and constitute a part of this specification, illustrate a preferred embodiment of the invention and, together with the description, serve to explain the principles of the invention.

Reference will now be made in detail to the present preferred embodiment of the invention which is illustrated in the accompanying drawings.

Figure 1:
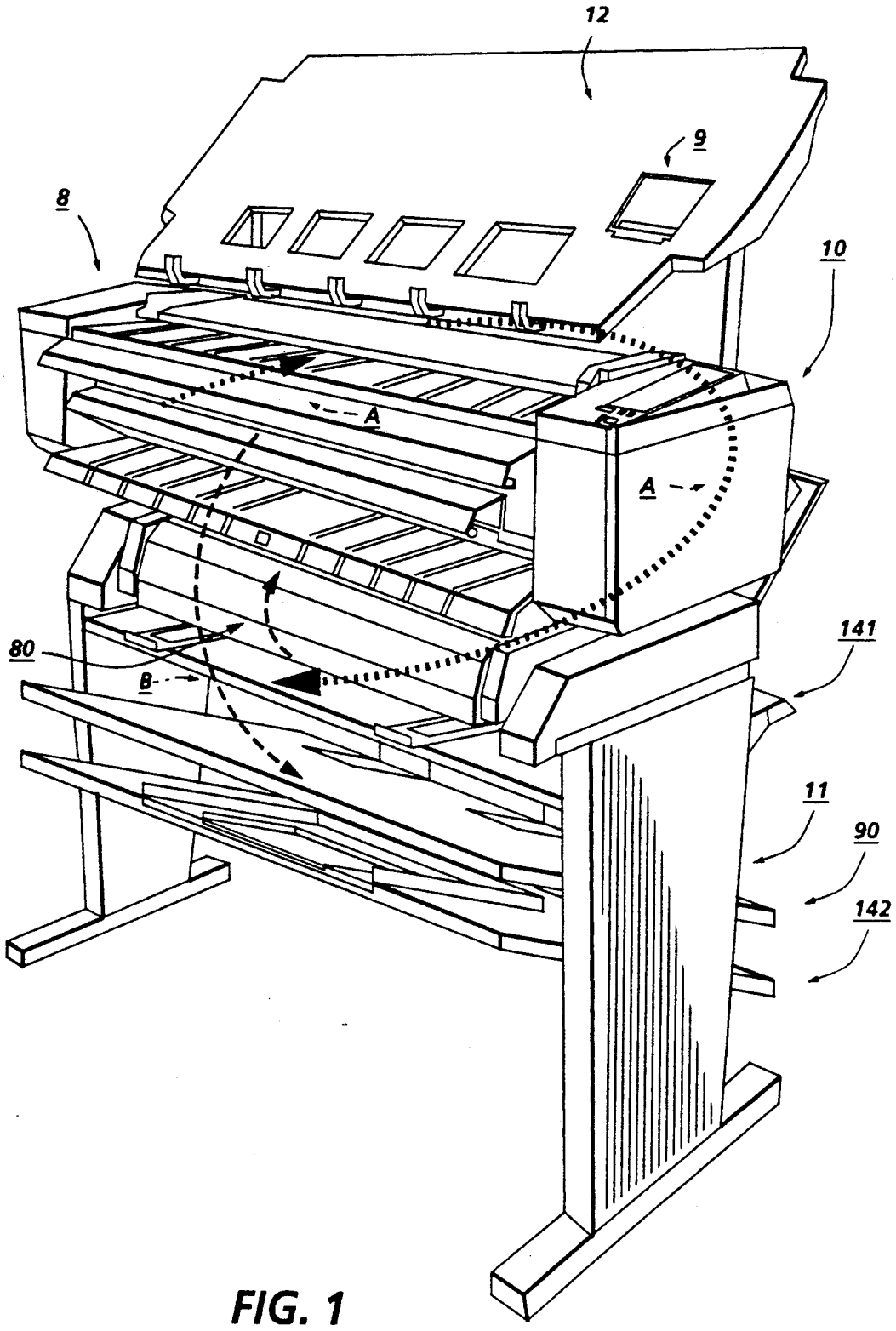
FIG. 1 is a perspective view of an embodiment of the apparatus made in accordance with the present invention for feeding large copy sheet media into a reproduction machine while maintaining a small machine footprint.
Figure 2:
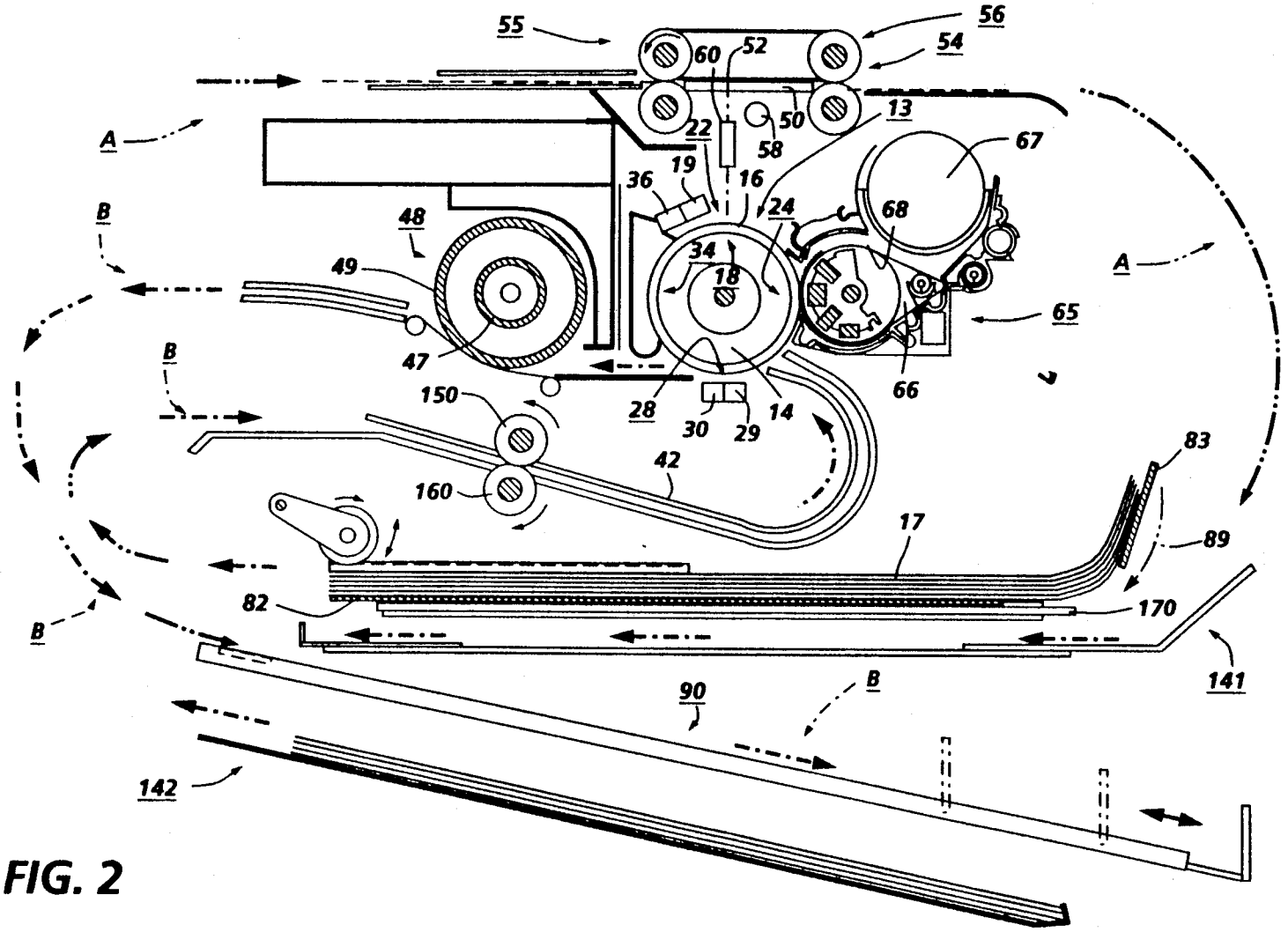
FIG. 2 is a partial schematic side view of the machine of FIG. 1 showing the copy media insert tray of the present invention mounted on top of existing copy media.

Referring to FIGS. 1 and 2 of the drawings there is shown by way of example an automatic xerographic reproduction or printing machine, designated generally by the numeral 8 incorporating the media insert tray structure of the present invention.

Machine 8 has a suitable frame or housing 10 within which the machine xerographic section 13 is operatively supported. The xerographic section 13 is supported by stand 11. Briefly, and as will be familiar to those skilled in the art, the machine xerographic section 13 includes a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document being copied or reproduced, development station 24 where the latent electrostatic image created on photoconductive surface 16 is developed by toner, transfer station 28 with transfer corotrons 29, 30 for transferring the developed image to a suitable copy substrate material such as a copy sheet 17 brought forward in timed relation with the developed image on photoconductive surface 16, and cleaning station 34 that could include a cleaning blade and discharge corotron 36 for removing leftover developer from photoconductive surface 16 and neutralizing residual charges thereon.

Copy sheets 17 are brought forward to transfer station 28 by idler roll 150 and registration/drive roll 160 which is controlled by a conventional controller (not shown), with sheet guides 42, 43 serving to guide the sheet through an approximately 180° turn prior to transfer station 28. Following transfer, the sheet 17 is carried forward to a fusing section 48 where the toner image is fixed by fusing roll 49. Fusing roll 49 is heated by a suitable heater such as lamp 47 disposed within the interior of roll 49. After fixing, the copy sheet 17 is discharged into a catch tray 90.

A transparent platen 50 supports a document as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56, respectively, on each side of scan point 52 for moving a document across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer within canister 67. As will be understood by those skilled in the art, developer comprises a mixture of larger carrier particles and smaller toner or ink particles. A rotatable magnetic brush developer roll 68 is disposed in predetermined operative relation to the photoconductive surface 16 in developer housing 65, roll 68 serving to bring developer from sump 66 into developing relation with photoreceptor 14 to develop the latent electrostatic images formed on the photoconductive surface 16. All of the machine functions are controlled by a conventional controller or microprocessor.

As shown in FIGS. 1–3B, automatic sheet feeder 80 is positioned between xerographic processor housing 10 and support stand 11 and includes a conventionally heated, two-part retractable tray 81 for supporting copy sheets in a stack-like fashion. A first portion 82 of the two-part tray 81 is non-flexible and is adapted to support copy sheets in a substantially horizontal plane while a second portion 83 of the two-part tray 81 is pivotally connected by suitable conventional means to first portion 82 at pivot 84 and adapted to flex along arc 89 when a cam follower member 85 attached thereto comes into contact with a cam member 86 which is supported by frame member 87 and thereby support the rear an end portion of copy sheet inserted into tray 81 in a bent or curved fashion when the tray is in its operating position underneath housing 10 as in FIG. 3A. Flexible tray 81 has advantages over prior copy sheet trays in that it allows machine base 11 to include a document return function without extending the back of the unit as a whole and thereby increasing the footprint of the unit and its flexing feature fans the copy sheets, thus breaking the edge bond that sheared copy sheets have and as a result, enhances feeding of the copy sheets by minimizing multi-sheet feeding. Additionally, the tray is supported by and positioned on stand or table 11 for easy access when loading with copy sheets is required.

Copy sheet tray 81 is withdrawn from feeder frame 11 when copy sheets have been exhausted and flexible portion 83 thereof pivots around pivot point 84 from an angled position to a horizontal position. The same procedure is followed when different sized copy sheets are to be placed within the tray.

Figure 3A:
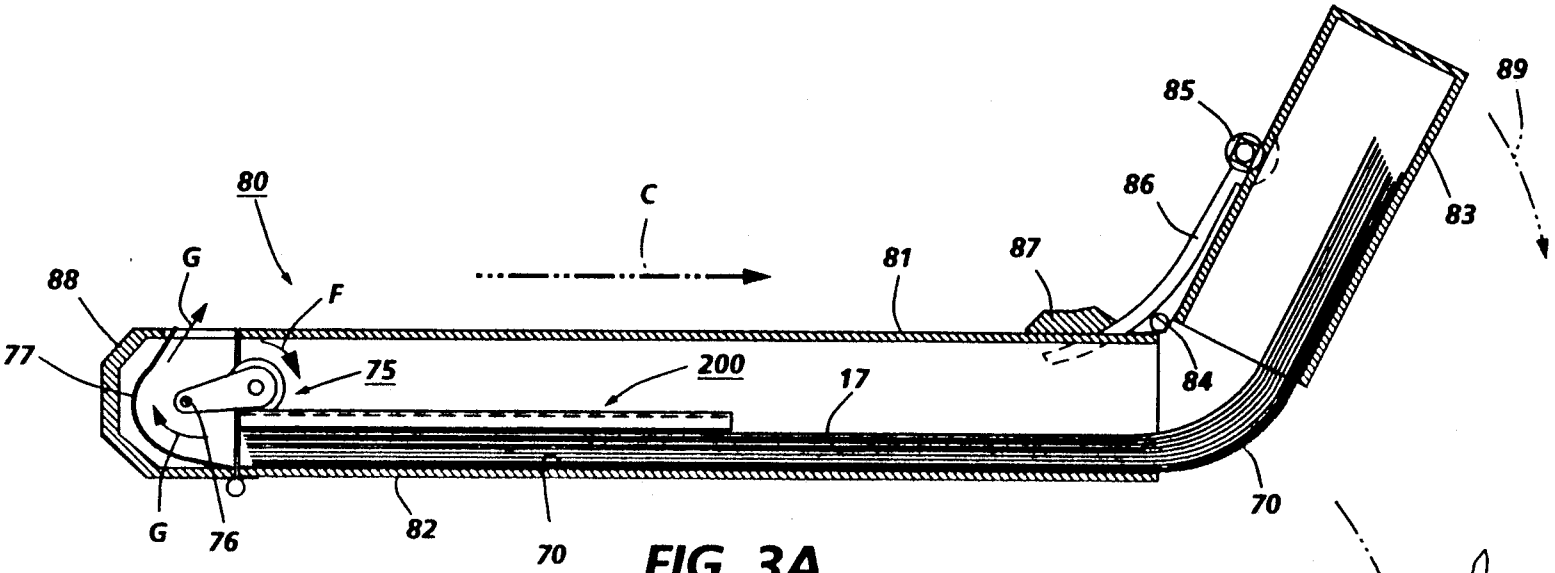
FIGS. 3A and 3B show enlarged schematic side views of a flexible copy paper tray employed in the printer of FIGS. 1 and 2 in an "in-use" position in FIG. 3A and a copy sheet loading position in FIG. 3B.
Figure 3B:
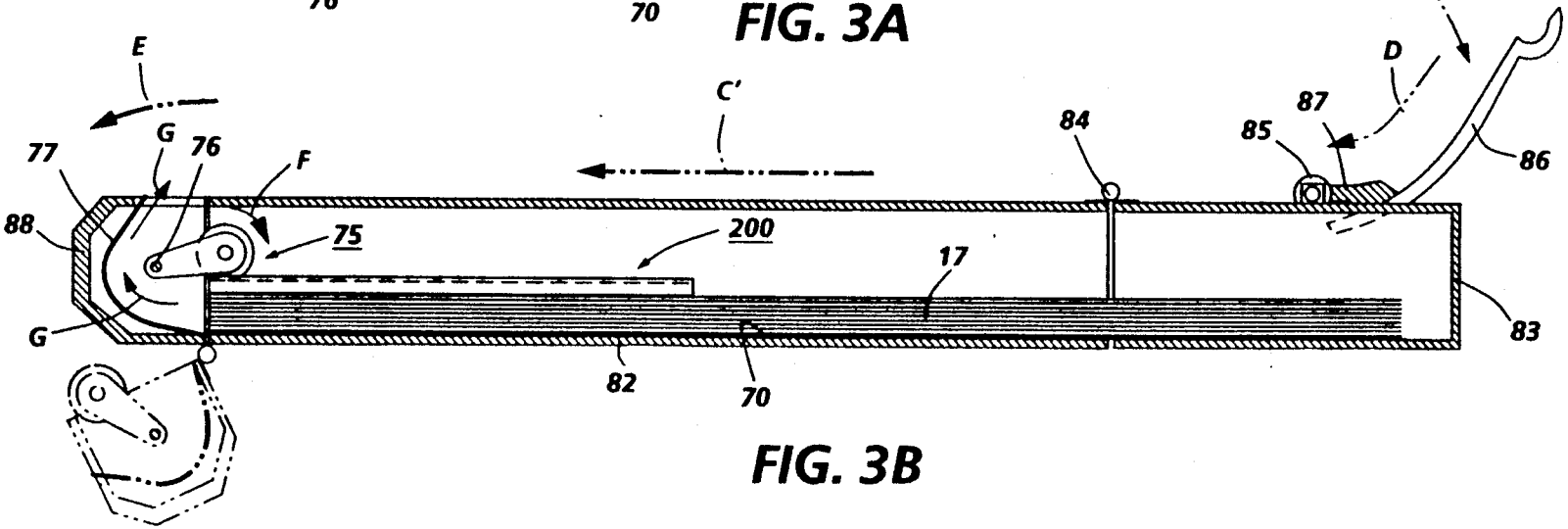

With reference to FIGS. 3A and 3B, copy sheet tray 81 is adapted to slide on rails 170 of FIG. 1 in the direction of arrows C and C'. For copy sheet insertion purposes, tray 81 is pulled to the left as indicated by arrow C' in FIG. 3B to an open position and housing 88 is rotated in the direction of arrow E to the position shown in phantom which removes feeder 75 from interfering with the placement of copy sheets onto membrane 70. Membrane 70 is adhered to and extends along the bottom of tray portion 82 and also extends into but is not adhered to rotatable portion 83 of the tray. The membrane is made of a flexible material, such as, polyurethane and serves to seal copy sheets 17 from the environment outside tray 81 when the tray is in its in-use position shown in FIG. 3A. After copy sheets have been placed into the tray, it is pushed along rails 170 toward the back of machine 8 and into the position of FIG. 3A. This action causes feeder 75 to be positioned on top of copy sheets 17 for rotation in the direction of arrow F to feed copy sheets along baffle 77 in the direction of arrow G into the nip formed between idler roll 150 and registration roll 160.

In order to reduce the time and cumbersome handling of copy media required when there is a requirement to feed a different size copy media from the one already in a machine, a low cost tray for smaller media 200 that the operator inserts on the present media in feeder 80 is disclosed. There is no need to remove the large, hard to handle media when media insert 200 is used for smaller media since this media inset tray fits directly on top of copy media already in the paper feeder tray. Insert tray 200 can hold as many copy sheets as the space above copy sheets within the paper feeder tray will allow. Tray 200 can have independently adjustable side guides to allow for the size variations within a media size grouping. Retarding pads on the inside surfaces of upstanding sides 203 and 205 of tray 200 can be employed, if desired, to aid in the retention of media as the top sheet is fed.

Figure 4:
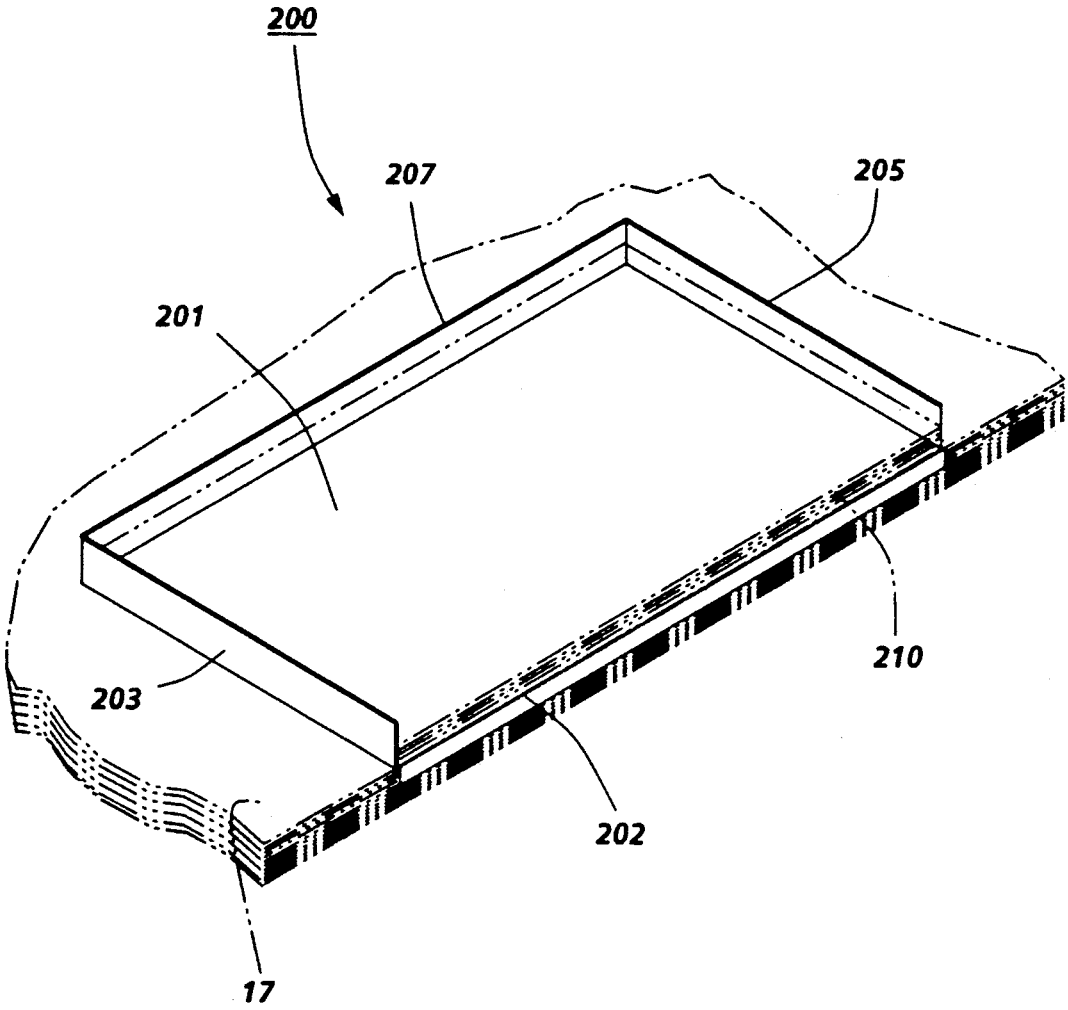
FIG. 4 shows an enlarged schematic perspective view of the copy media insert tray of the present invention in its "in-use" position.

As shown in FIG. 4, copy media insert tray 200 includes a media support surface 201 that has sides 203 and 205 connected thereto, as well as, rear end member 207. A downturned lip member 202 is connected to the front of support surface 201 and is placed against the front of the existing copy media stack in a machine in order to properly locate the copy media in the insert tray with respect to feed rolls of machine 8.

To use this device, the operator need only to have insert tray(s) 200 loaded and in a dry storage place. Then, when a particular size of copy media is required, the operator opens feeder drawer 80 and simply places a tray 200 with the required copy media size therein over the top of the existing media 17 in the feeder with lip 202 against the front of media 17 and closes the feeder drawer. The new copy media is now ready to run. Reversing the aforementioned steps, reverts the feeder to feeding the normal media. Copy media insert tray 200 provides a safe storage and handling feature for smaller copy media which often becomes damaged and causes customer frustration and expense later on when the customer tries to use it and it jams or otherwise is an unacceptable copy. In short, insert tray 200 is a feeder tray, as well as, a storage tray. Insert trays of varied sizes are shown stacked on tray 142 for convenience.

In operation, a document is inserted into machine 8 in the direction of arrow A. The document advances to a point an stops for the feeding of a copy sheet. Automatic activation of the feed rolls will advance the copy sheet about 4–6" out of either tray 80 or 200 and into the registration rolls of the machine as shown by arrow B. The microprocessor starts the document and copy sheet in synchronism with each other with the document traveling in the direction of arrow A and the copy sheet traveling from either feeder tray 80 or insert tray 200 in the direction of arrow B as shown in FIG. 1. This process is repeated as necessary for the number of copies required.

It should now be understood that a low cost and efficient copy media insert tray has been disclosed that allows a machine to print onto large copy sheets, e.g., "C" size which is about 18×24", without having to remove the larger "D" size copy media which is about 24×36" from the feeder.

While the invention has been described with reference to the structure shown, it is not confined to the specific details set forth, but is intended to cover such modifications or changes as may come within the scope of the following claims.

What is claimed is:

1. A copy media auxiliary insert tray, comprising:

a first portion thereof for supporting a stack of copy media in a horizontal plane;

a second portion thereof connected to said first portion including a rear end member and side members configured orthogonally with respect to said first portion and extending upward with respect to said first portion in order to position the stack of copy media for feeding from said first portion of said media insert tray; and a third portion located at the sheet exiting end of said first portion that extends orthogonally downward with respect to said first portion, said third portion being adapted to be placed against the front end of an existing stack of copy media in order to properly locate the copy media in the insert tray with respect to a sheet feed means.

2. In a machine which feeds large copy sheets to receive images thereon from a copy sheet tray therein, the improvement for feeding a variety of copy sheet sizes from the copy sheet tray without removing copy sheets already present within the copy sheet tray, comprising:

a portable, insertable, auxiliary copy sheet support means for insertion on top of copy sheets present in the copy sheet tray so that smaller sized copy sheets can be fed therefrom, said portable, insertable copy sheet support means includes a copy sheet support surface, upstanding sides and an upstanding rear end member connected thereto and a downturned member connected to said copy sheet support surface at the front copy sheet exit end thereof, and wherein said downturned member is adapted to be placed against the front end of an existing stack of copy sheets in order to properly locate the copy sheets on the copy sheet support means with respect to a sheet feed means of the machine.

3. In a machine which feeds large copy sheets to receive images thereon from a copy sheet tray therein, the improvement for feeding a variety of copy sheet sizes from the copy sheet tray without removing copy sheets already present within the copy sheet tray, comprising:

feed rolls for feeding copy sheets from the tray; and a portable, insertable, auxiliary copy sheet device for insertion on top of copy sheets present in the copy sheet tray so that smaller sized copy sheets can be fed therefrom, and wherein said portable, insertable, auxiliary copy sheet device includes a copy sheet support surface, upstanding sides, an upstanding end member connected thereto and a downturned member connected to said copy sheet support surface at the copy sheet exit end thereof, and wherein said downturned member is adapted to be placed against the front end of an existing stack of copy sheets in order to properly locate the copy sheets on the copy sheet support means with respect to the feed rolls.

* * * * *